US012663220B2

(12) United States Patent
Cheng et al.

(10) Patent No.: US 12,663,220 B2
(45) Date of Patent: Jun. 23, 2026

(54) HEAT DISSIPATION DEVICE

(71) Applicant: AURAS TECHNOLOGY CO., LTD., New Taipei City (TW)

(72) Inventors: Yi-Le Cheng, New Taipei City (TW); Jyun-Wei Huang, New Taipei City (TW); Cheng-Ju Chang, New Taipei City (TW); Chih-Wei Chen, New Taipei City (TW); Tien-Yao Chang, New Taipei City (TW); Che-Wei Kuo, New Taipei City (TW)

(73) Assignee: AURAS TECHNOLOGY CO., LTD., New Taipei City (TW)

( * ) Notice: Subject to any disclaimer, the term of this patent is extended or adjusted under 35 U.S.C. 154(b) by 134 days.

(21) Appl. No.: 18/523,053

(22) Filed: Nov. 29, 2023

(65) Prior Publication Data

US 2024/0230241 A1 Jul. 11, 2024

Related U.S. Application Data

(60) Provisional application No. 63/479,324, filed on Jan. 10, 2023.

(51) Int. Cl.

| | |
|---|---|
| ***F28D 15/02*** | (2006.01) |
| ***F28D 15/04*** | (2006.01) |
| *F28D 21/00* | (2006.01) |

(52) U.S. Cl.
CPC ..... *F28D 15/0266* (2013.01); *F28D 15/0275* (2013.01); *F28D 15/046* (2013.01); *F28D 2021/0028* (2013.01)

(58) Field of Classification Search
CPC ..... F28D 15/0266; F28D 15/0275
See application file for complete search history.

(56) References Cited

U.S. PATENT DOCUMENTS

2016/0187074 A1* 6/2016 Lin ..... F28D 15/0233 165/67
2017/0343297 A1* 11/2017 Lan ..... F28D 15/0266
2018/0372419 A1* 12/2018 Liu ..... F28D 15/0275

FOREIGN PATENT DOCUMENTS

CN 214800420 U * 11/2021 ..... H05K 7/20409
CN 215269229 U * 12/2021 ..... F28F 9/26

* cited by examiner

*Primary Examiner* — Jianying C Atkisson
*Assistant Examiner* — Khaled Ahmed Ali Al Samiri
(74) *Attorney, Agent, or Firm* — Amin, Turocy & Watson, LLP

(57) ABSTRACT

A heat dissipation device is provided and includes: a first vapor chamber having a first chamber and two first openings; and a second vapor chamber disposed on the first vapor chamber and having a second chamber, two bending portions and a middle portion. The two bending portions are inserted into the two first openings respectively to connect the first vapor chamber, such that the second chamber is in communication with the first chamber.

12 Claims, 10 Drawing Sheets

HEAT DISSIPATION DEVICE

BACKGROUND

1. Technical Field

The present disclosure relates to the field of heat dissipation, and more particularly, to a heat dissipation device using vapor chambers.

2. Description of Related Art

In response to the needs of modernization, computers and various electronic devices have developed rapidly and their performance has been continuously improved. However, during the process of modernization, heat dissipation problems caused by high-performance hardware have also arisen. Generally speaking, computers and various electronic devices usually use heat dissipation components to dissipate heat. For example, thermal paste or heat sinks are attached onto the electronic components to be dissipated so as to absorb and dissipate the heat. However, the effect of this heat dissipation method is limited, so heat dissipation components that use the phase change of the working fluid to promote heat conduction have been developed.

The above-mentioned heat dissipation components achieve the purpose of transferring heat through the phase change and flow direction of the working fluid. However, such heat dissipation components are still unable to maintain effective and consistent heat dissipation when faced with the large amount of heat energy generated by high-power processors, thereby resulting in poor overall heat dissipation efficiency.

Therefore, how to provide a heat dissipation device that can solve the above problems is one of the issues that the industry needs to overcome urgently.

SUMMARY

The present disclosure provides a heat dissipation device, which comprises: a first vapor chamber including a first upper cover, a first lower cover, two first openings and a capillary layer, wherein the first upper cover and the first lower cover are assembled with each other to surround and define a first chamber, the capillary layer is disposed on the first lower cover and located in the first chamber, the two first openings are spaced apart from each other and formed penetrating through the first upper cover and communicate with the first chamber, and the first lower cover is used to contact a heat source; and a second vapor chamber disposed on the first vapor chamber and including: a second upper cover; a second lower cover assembled with the second upper cover to surround and define a second chamber and define two bending portions and a middle portion, wherein the middle portion is spaced apart from the first upper cover, wherein the two bending portions are bent to connect opposite ends of the middle portion, and are respectively inserted into the two first openings to be connected to the first upper cover, so that the second chamber communicates with the first chamber; and a plurality of second openings respectively formed in the two bending portions and communicating with the second chamber, wherein the plurality of second openings are located in the first chamber when the two bending portions are respectively inserted into the two first openings.

In the aforementioned heat dissipation device, the second vapor chamber further comprises a second capillary structure disposed on the second lower cover and located in the second chamber.

In the aforementioned heat dissipation device, the second vapor chamber further comprises a plurality of first capillary structures that are accommodated in the second chamber and extend to the first chamber via the plurality of second openings and the two first openings respectively.

In the aforementioned heat dissipation device, the second capillary structure is a powder sintered body or a mesh body, and the plurality of first capillary structures are strip-shaped fiber bodies.

In the aforementioned heat dissipation device, the second vapor chamber further comprises a plurality of first support units and a plurality of second support units, wherein the plurality of first support units are disposed on the second upper cover, located in the second chamber and corresponding to the middle portion, wherein the plurality of second support units are disposed on the second upper cover, located in the second chamber, and are respectively located on opposite sides of the plurality of first support units and corresponding to the two bending portions.

In the aforementioned heat dissipation device, the plurality of first support units are cylinders, and the plurality of second support units are long strips.

In the aforementioned heat dissipation device, the first vapor chamber further comprises a plurality of pillars that are disposed on the first upper cover and located in the first chamber.

In the aforementioned heat dissipation device, the plurality of first capillary structures are bonded to the capillary layer.

In the aforementioned heat dissipation device, the first vapor chamber further comprises a bonding layer formed between the plurality of first capillary structures and the capillary layer, or formed on the capillary layer and covering the plurality of first capillary structures.

In the aforementioned heat dissipation device, the bonding layer is composed of powdered metal and polymer material, and a weight ratio of the powdered metal to the polymer material is less than or equal to 1.

In the aforementioned heat dissipation device, the present disclosure further comprises two annular members disposed on the first upper cover and surrounding the two first openings and the two bending portions respectively.

In the aforementioned heat dissipation device, the second vapor chamber further comprises a plurality of bumps extending outwardly from the second upper cover and the second lower cover respectively, so that one of the plurality of second openings is formed between any two of the plurality of bumps.

In the aforementioned heat dissipation device, the second capillary structure includes a second main capillary structure and a plurality of second sub-capillary structures, wherein the plurality of second sub-capillary structures overlap some of the plurality of bumps, and the plurality of second sub-capillary structures are connected to the second main capillary structure and in a capillary communication to the capillary layer.

In the aforementioned heat dissipation device, an R angle formed by the two bending portions is one to two times a thickness of a plate formed by the second upper cover and the second lower cover.

In the aforementioned heat dissipation device, the second vapor chamber has a U-shaped cross-section.

In the aforementioned heat dissipation device, the present disclosure further comprises a first fin set disposed between the first upper cover and the second lower cover and located between the two bending portions.

In the aforementioned heat dissipation device, the present disclosure further comprises a second fin set disposed on the second upper cover and completely corresponding to the middle portion.

To sum up, in the heat dissipation device of the present disclosure, providing an annular second vapor chamber on the first vapor chamber can increase the contact area of more vaporized working fluid, so that the heat dissipation device of the present disclosure can efficiently absorb heat energy and dissipate heat when faced with a large amount of heat energy generated by a high-power processor. Therefore, the heat dissipation device of the present disclosure can provide higher heat dissipation efficiency as a whole, and can maintain effective and consistent heat dissipation.

BRIEF DESCRIPTION OF THE DRAWINGS

FIG. 5' is an exploded schematic view of the second vapor chamber before bending in the heat dissipation device according to another embodiment of the present disclosure.

DETAILED DESCRIPTIONS

The following describes the implementation of the present disclosure with examples. Those skilled in the art can easily understand other advantages and effects of the present disclosure from the contents disclosed in this specification, and can also implement or apply these advantages and effects via other different specific embodiments.

Figure 1:
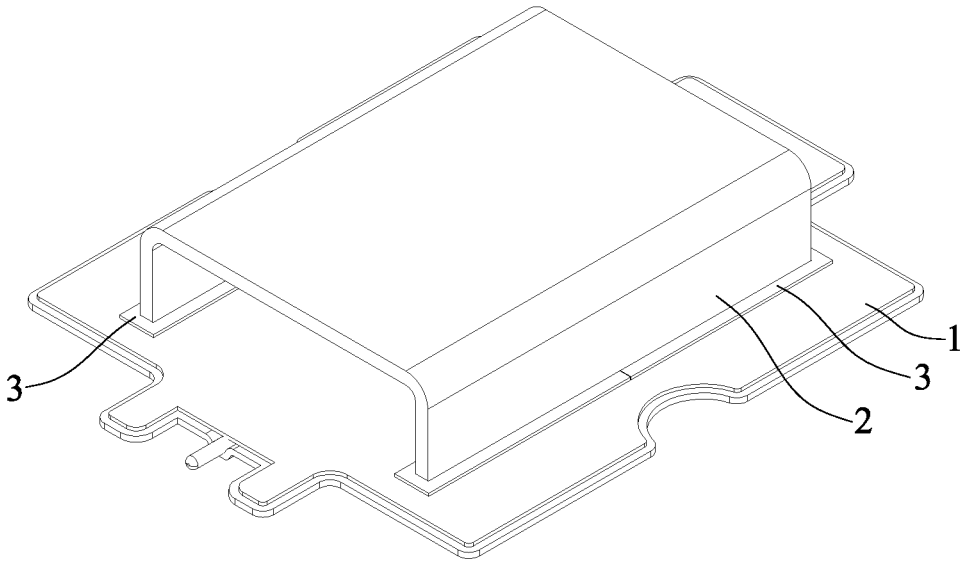
FIG. 1 is a schematic view of a heat dissipation device according to the present disclosure.
Figure 2:
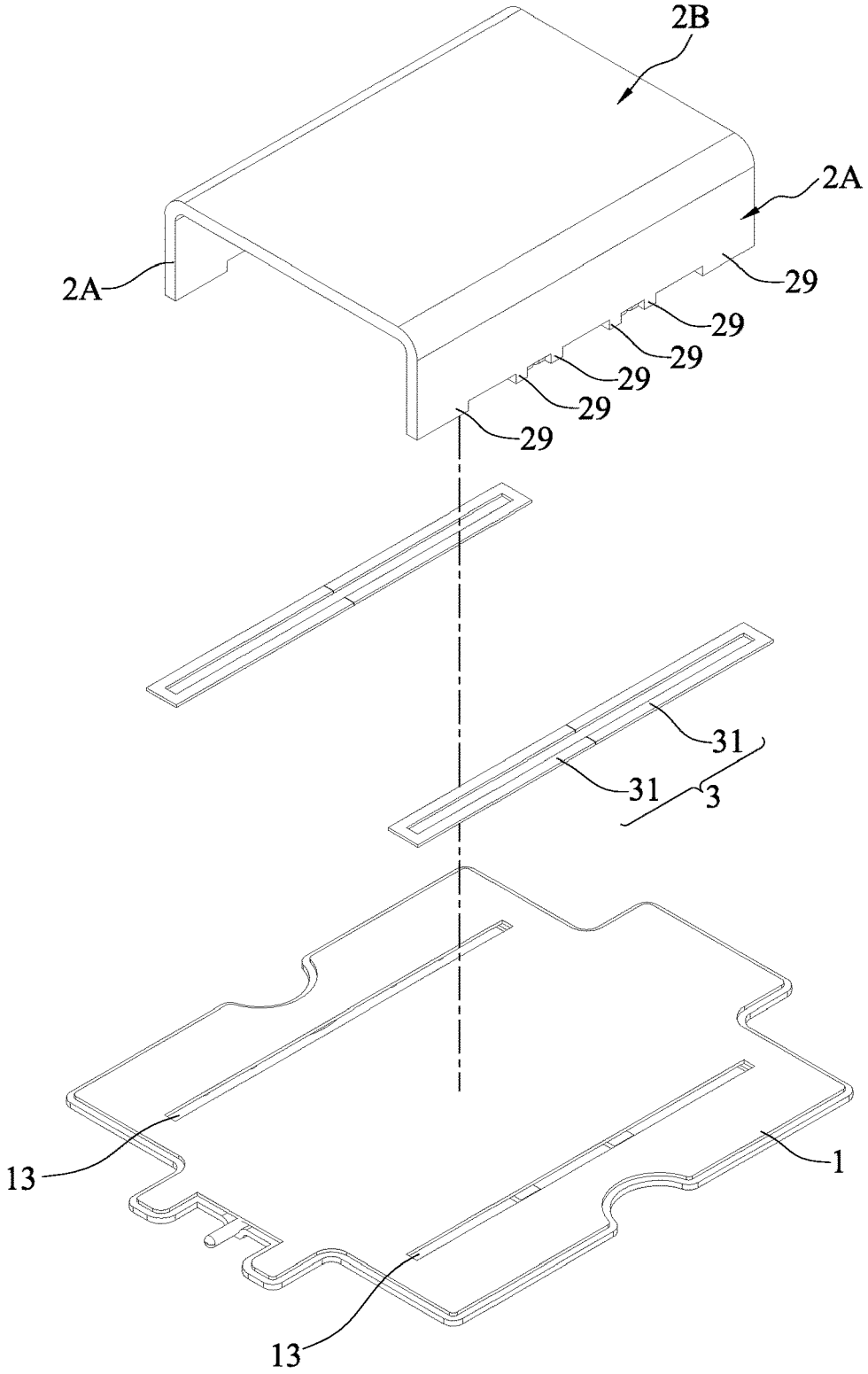
FIG. 2 is an exploded schematic view of the heat dissipation device according to the present disclosure.

Please refer to FIG. 1 and FIG. 2. A heat dissipation device 100 of the present disclosure includes a first vapor chamber 1 and a second vapor chamber 2. The second vapor chamber 2 is disposed on the first vapor chamber 1.

Figure 3:
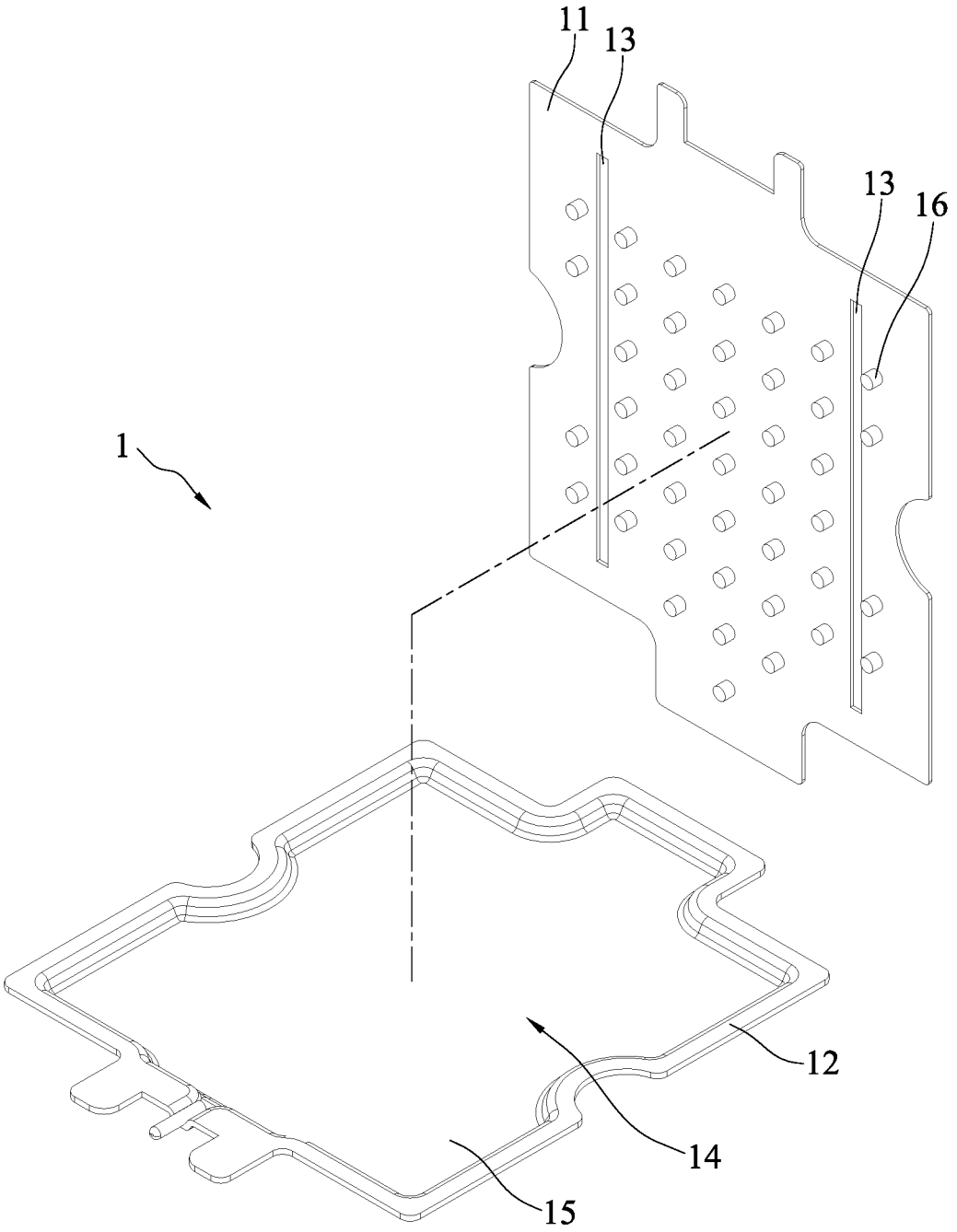
FIG. 3 is an exploded schematic view of a first vapor chamber in the heat dissipation device according to the present disclosure.

Referring further to FIG. 3, the first vapor chamber 1 includes a first upper cover 11, a first lower cover 12, two first openings 13, a first chamber 14, a capillary layer 15 and a plurality of pillars 16. The first upper cover 11 and the first lower cover 12 are assembled together to surround and define the first chamber 14 inside the first upper cover 11 and the first lower cover 12. The two first openings 13 are spaced apart and parallel to each other and formed penetrating through the first upper cover 11 and communicate with the first chamber 14. The first lower cover 12 is used to contact a heat source (such as a chip). In one embodiment, the first upper cover 11 and the first lower cover 12 are bonded together from top to bottom by diffusion bonding or copper paste brazing, but the present disclosure is not limited to as such.

The capillary layer 15 is disposed on the inner surface of the first lower cover 12 and is located in the first chamber 14. The plurality of pillars 16 are spaced apart from each other on the inner surface of the first upper cover 11 and located in the first chamber 14. After the first upper cover 11 and the first lower cover 12 are assembled with each other, the plurality of pillars 16 can contact the capillary layer 15. In one embodiment, the capillary layer 15 is for example a powder sintered body sintered from metal powder (such as copper) formed on the inner surface of the first lower cover 12, or the capillary layer 15 is a mesh body (such as a copper mesh) laid on the inner surface of the first lower cover 12; and the pillars 16 are for example cylinders sintered from metal powder (such as copper) formed on the inner surface of the first upper cover 11, but the present disclosure is not limited to as such. The capillary layer 15 and the pillars 16 have the function of driving the working fluid with capillary force.

Figure 4:
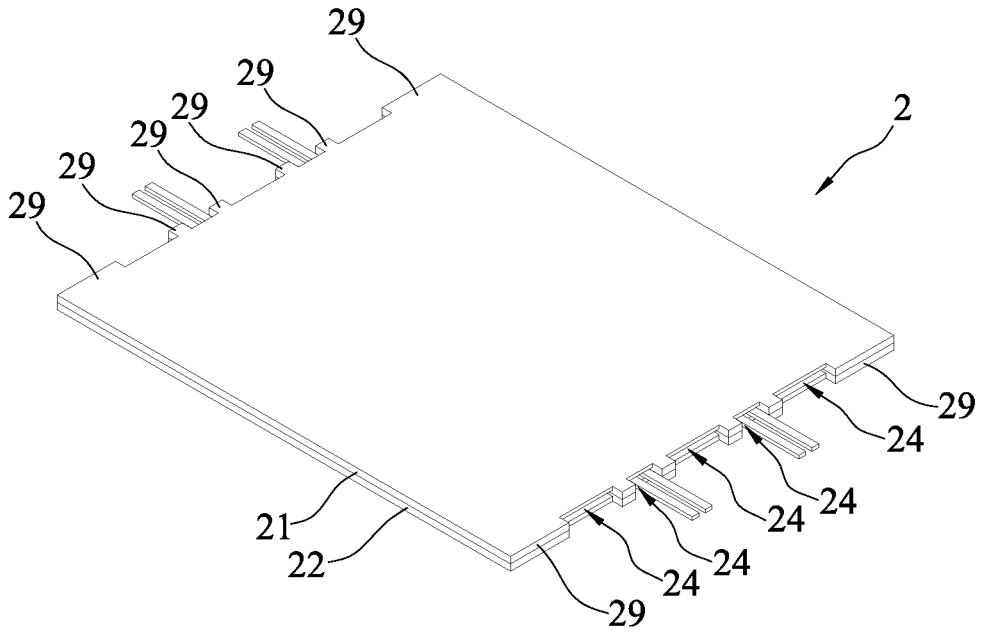
FIG. 4 is a schematic view of a second vapor chamber before bending in the heat dissipation device according to the present disclosure.
Figure 5:
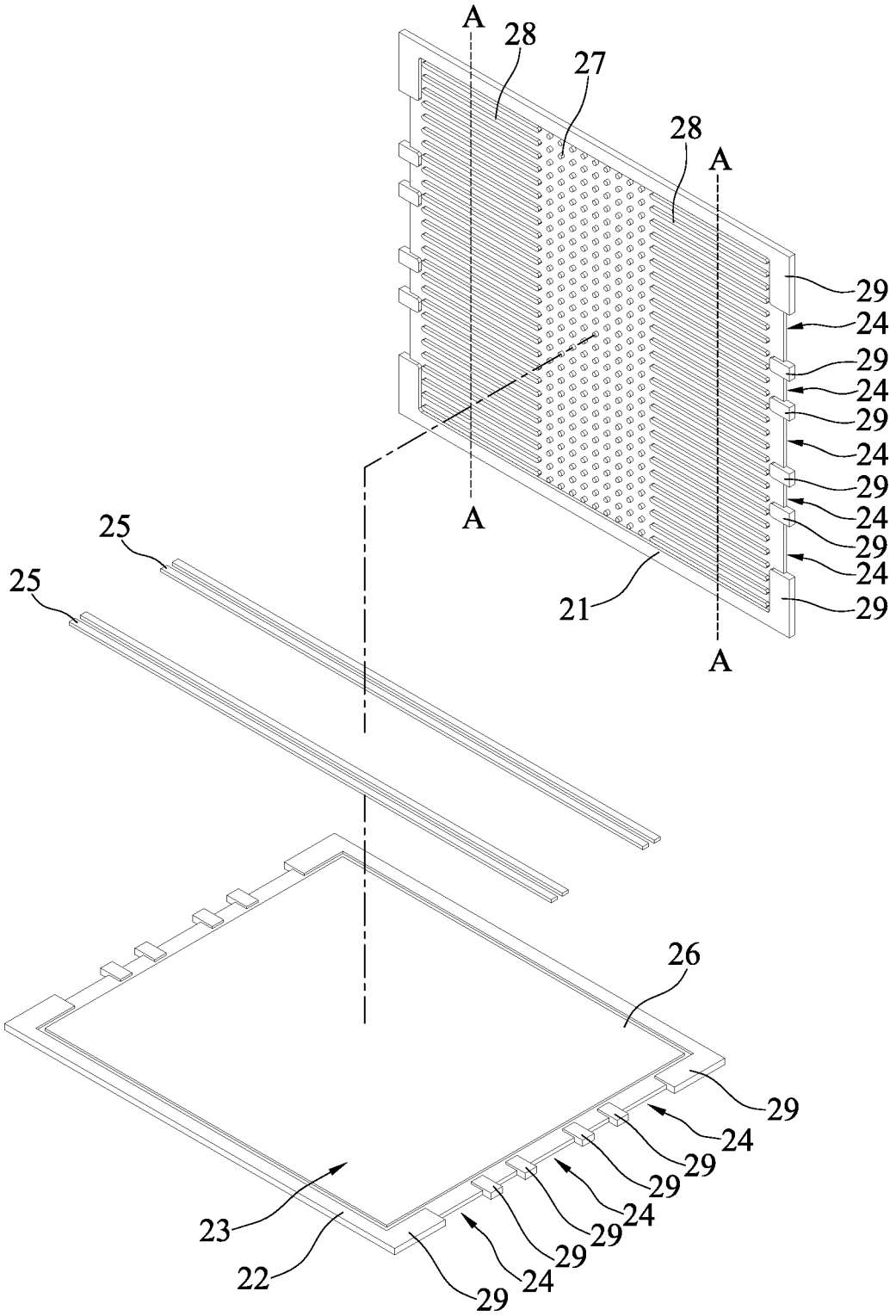
FIG. 5 is an exploded schematic view of the second vapor chamber before bending in the heat dissipation device according to the present disclosure.
Figure 5:
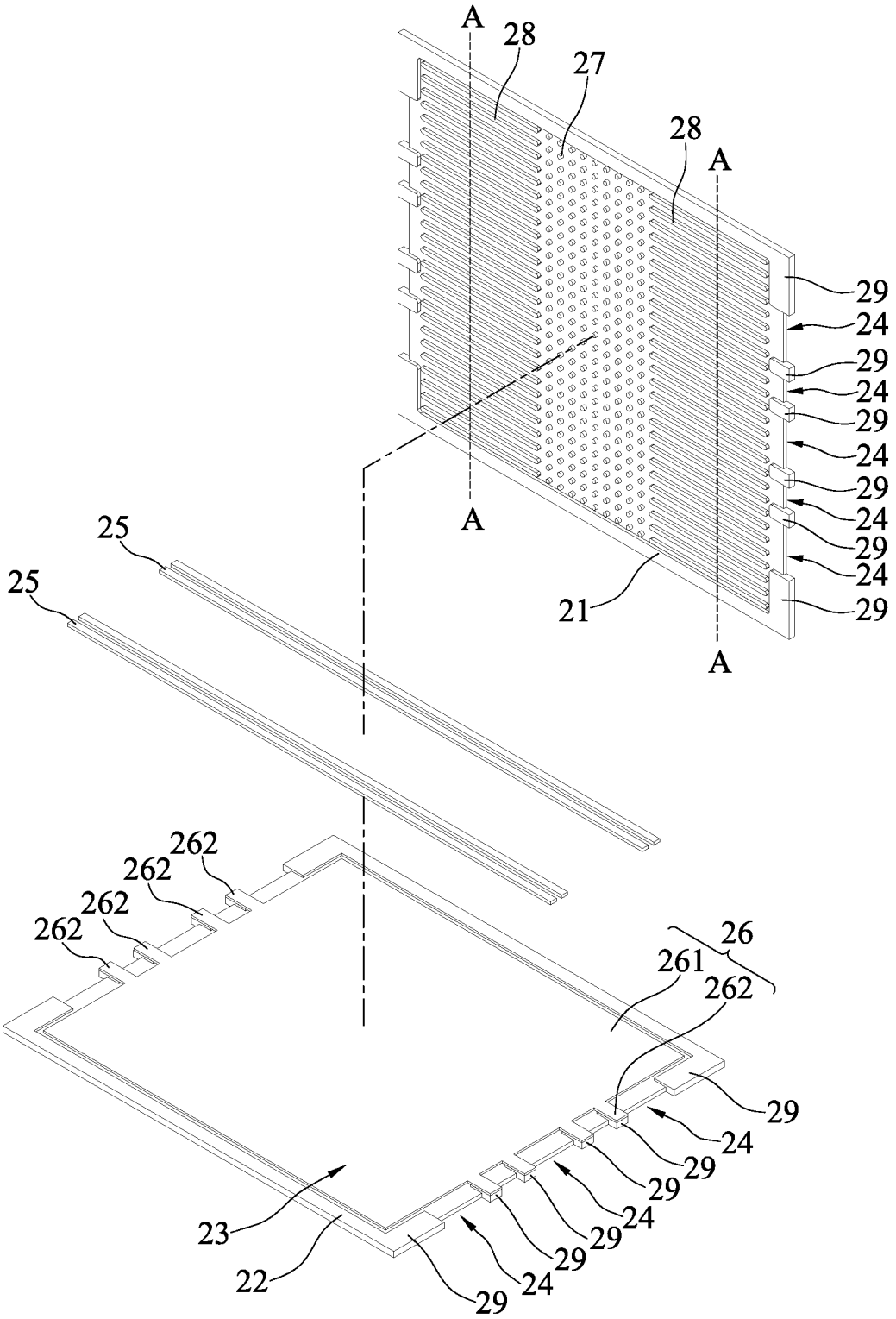
Figure 6:
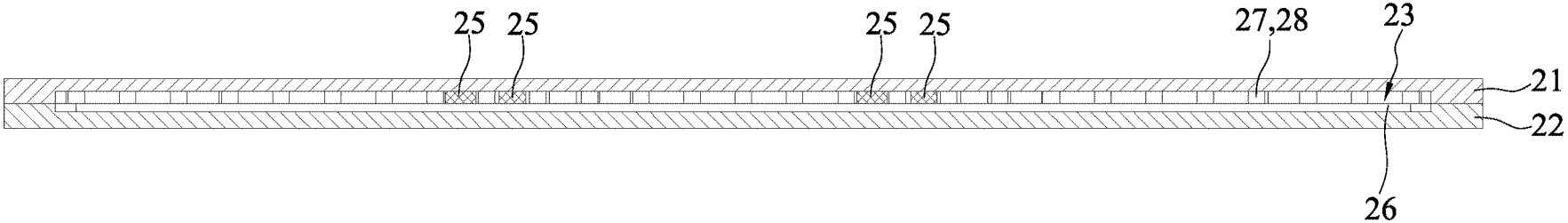
FIG. 6 is a schematic cross-sectional view of the second vapor chamber in the heat dissipation device according to the present disclosure.

Referring to FIG. 4, FIG. 5 and FIG. 6, the second vapor chamber 2 includes a second upper cover 21, a second lower cover 22, a second chamber 23, a plurality of second openings 24, a plurality of first capillary structures 25, a second capillary structure 26, a plurality of first support units 27, a plurality of second support units 28 and a plurality of bumps 29. The second upper cover 21 and the second lower cover 22 are assembled with each other to surround and define the second chamber 23 inside the second upper cover 21 and the second lower cover 22. After the second upper cover 21 and the second lower cover 22 are assembled with each other, they are bent by stamping (for example, along the A-A fold line shown in FIG. 5), so that two bending portions 2A and a middle portion 2B can be defined (as shown in FIG. 2), that is, the two bending portions 2A are respectively bent to connect the opposite ends of the middle portion 2B, so that the second vapor chamber 2 has a U-shaped cross-section. In one embodiment, the second upper cover 21 and the second lower cover 22 are bonded together from top to bottom by diffusion bonding or copper paste brazing, and the plurality of second openings 24 are left on the opposite sides, but the present disclosure is not limited to as such.

In one embodiment, the R angle formed by the two bending portions 2A is one to two times the thickness of the plate formed by the second upper cover 21 and the second lower cover 22, but the present disclosure is not limited to as such.

The plurality of bumps 29 extend outwardly from the second upper cover 21 and the second lower cover 22 (or from the ends of the two bending portions 2A) and spaced apart from each other, so that one of the plurality of second openings 24 is formed between any two of the plurality of bumps 29, that is, the second openings 24 and the bumps 29 are alternately formed at the ends of the bending portions 2A to form a battlement-shaped structure. In addition, the plurality of second openings 24 communicate with the second chamber 23.

In one embodiment, the plurality of bumps 29 abut or join the capillary layer 15, but the present disclosure is not limited to as such.

The plurality of first capillary structures 25 are accommodated in the second chamber 23 and extend outward from the plurality of second openings 24 respectively. In one embodiment, the first capillary structure 25 is a strip-shaped fiber body, and the strip-shaped fiber body includes fiber bundles twisted and wound by a plurality of fiber threads, wherein the fiber threads are metal fiber threads, glass fiber threads, carbon fiber threads, polymer fiber threads, or other capillary materials that can guide the working fluid, but the present disclosure is not limited to as such. The first capillary structure 25 has the function of driving the working fluid with capillary force.

The second capillary structure 26 is disposed on the inner surface of the second lower cover 22 and is located in the second chamber 23. In one embodiment, the second capillary structure 26 is for example a powder sintered body sintered from metal powder (such as copper) formed on the inner surface of the second lower cover 22, or the second capillary structure 26 is a mesh body (such as a copper mesh) laid on the inner surface of the second lower cover 22, but the present disclosure is not limited to as such. The second capillary structure 26 has the function of driving the working fluid with capillary force.

The plurality of first support units 27 are spaced apart from each other on the inner surface of the second upper cover 21 and located in the second chamber 23, and correspond to the middle portion 2B. In one embodiment, the plurality of first support units 27 are, for example, cylinders sintered from metal powder (such as copper) formed on the inner surface of the second upper cover 21 and arranged in an array. However, the present disclosure is not limited to as such.

The plurality of second support units 28 are spaced apart from each other on the inner surface of the second upper cover 21 and located in the second chamber 23, and are respectively located on opposite sides of the plurality of first support units 27 and further correspond to the two bending portions 2A. In one embodiment, the plurality of second support units 28 are, for example, long strips (long-strip bodies) sintered from metal powder (such as copper) formed on the inner surface of the second upper cover 21. These long strips can provide the required strength when the second vapor chamber 2 is bent by stamping, thereby increasing the supporting force and preventing the second upper cover 21 and the second lower cover 22 from being dented after bending. In addition, the second support unit 28 is formed extending in the direction of the second opening 24.

Figure 7A:
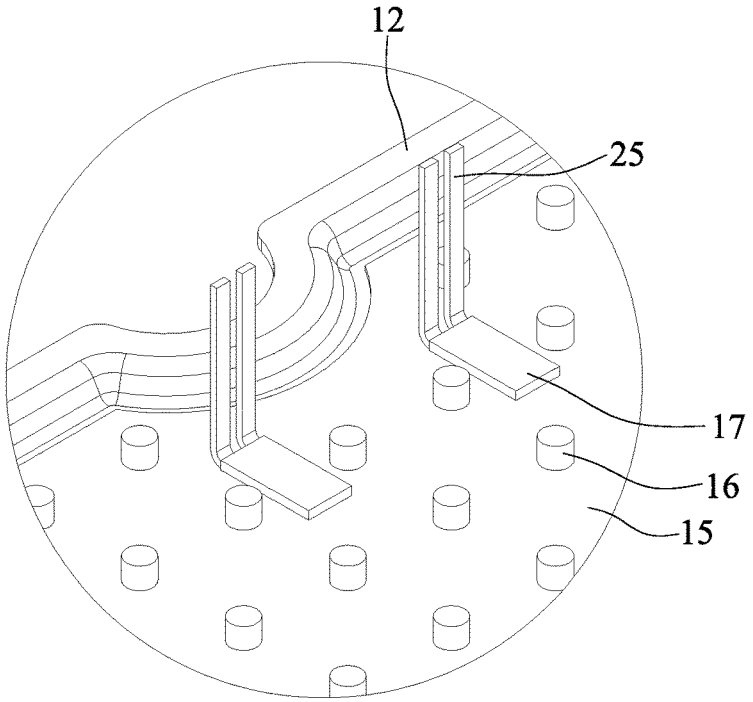
FIG. 7A and FIG. 7B are schematic views of the joint states of the first capillary structure in the heat dissipation device according to different embodiments of the present disclosure.
Figure 7B:
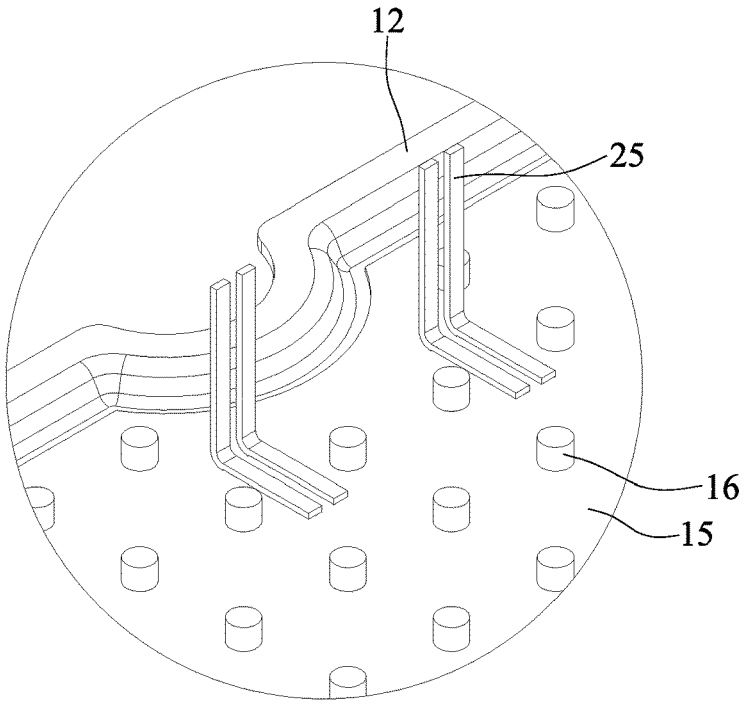
Figure 8:
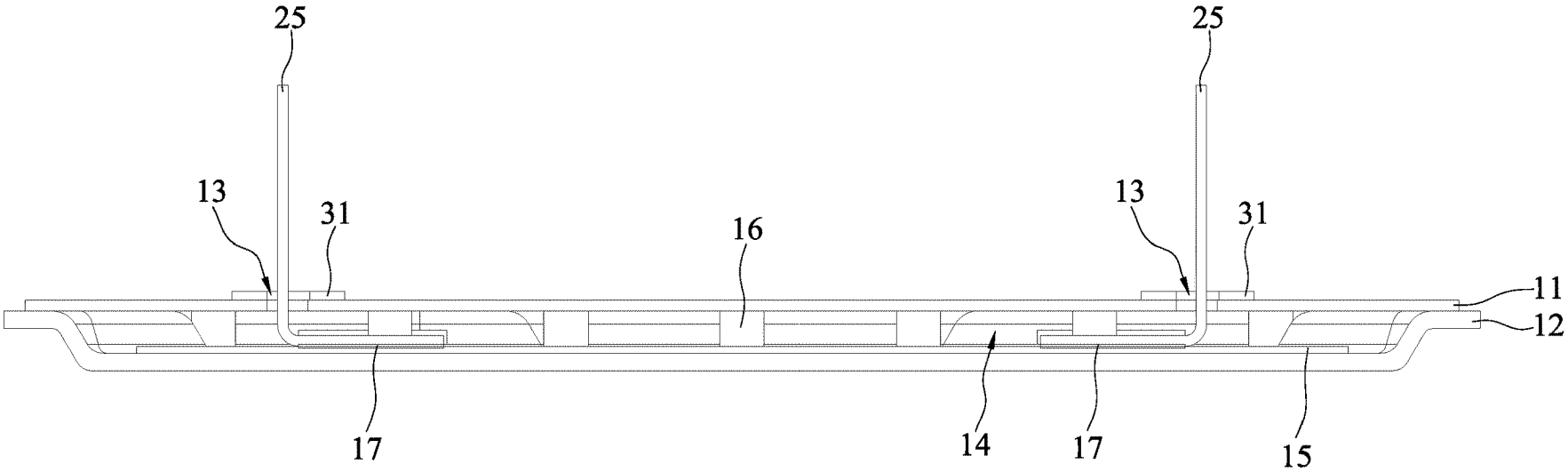
FIG. 8 is a schematic cross-sectional view of some components in the heat dissipation device according to the present disclosure.

After the second vapor chamber 2 is disposed on the first vapor chamber 1, the middle portion 2B is spaced apart from the first upper cover 11, and the two bending portions 2A are respectively inserted into the two first openings 13 to connect the first upper cover 11. At this time, the plurality of second openings 24 and the plurality of bumps 29 are located in the first chamber 14, so that the second chamber 23 communicates with the first chamber 14. The plurality of first capillary structures 25 extend to the first chamber 14 via the plurality of second openings 24 and the two first openings 13, and are bent and joined to the capillary layer 15. In one embodiment, as shown in FIG. 7B, the plurality of first capillary structures 25 can be directly sintered and combined with the capillary layer 15. In another embodiment, as shown in FIG. 7A, the first vapor chamber 1 may include a bonding layer 17. The bonding layer 17 may be in a block shape, formed on the capillary layer 15 and covering the plurality of first capillary structures 25. In another embodiment, as shown in FIG. 8, the bonding layer 17 is formed between the plurality of first capillary structures 25 and the capillary layer 15, that is, the plurality of first capillary structures 25 can be bonded to the capillary layer 15 via the bonding layer 17. In one embodiment, the bonding layer 17 may be a powder slurry or powder mud composed of powdered metal and polymer materials. After the bonding layer 17 is sintered and solidified, the plurality of first capillary structures 25 and the capillary layer 15 are joined. The weight ratio of the powdery metal to the polymer material is less than or equal to 1, which means that the weight of the powdery metal in the bonding layer 17 is less than or equal to the weight of the polymer material, but the present disclosure is not limited to as such.

After the second vapor chamber 2 is arranged on the first vapor chamber 1, the gap between the first vapor chamber 1 and the second vapor chamber 2 is edge-sealed by two annular members 3. Each of the annular members 3 is composed of two U-shaped metal bodies 31. The two U-shaped metal bodies 31 are arranged on the first upper cover 11 with the openings facing each other and surround the first opening 13 and the bending portion 2A respectively. The surfaces of the two U-shaped metal bodies 31 are coated with solder paste. The solder paste penetrates into the entire surfaces of the U-shaped metal bodies 31 by capillary force, and after the welding process, the intersection of the first opening 13 and the bending portion 2A is welded and closed, that is, the first chamber 14 and the second chamber 23 are closed.

In one embodiment, as shown in FIG. 5', the second capillary structure 26 includes a second main capillary structure 261 and a plurality of second sub-capillary structures 262, and the plurality of second sub-capillary structures 262 overlap with some of the plurality of bumps 29, wherein the plurality of second sub-capillary structures 262 connect the second main capillary structure 261 and are connected to the capillary layer 15 in a capillary manner. Specifically, the plurality of second sub-capillary structures 262 are spaced apart from each other and extend outward from opposite sides of the second main capillary structure 261, and are sandwiched between some of the plurality of bumps 29 of the second upper cover 21 and some of the plurality of bumps 29 of the second lower cover 22, wherein the way in which the plurality of second sub-capillary structures 262 are in a capillary communication to the capillary layer 15 is to use the capillary force generated by the gap between the plurality of second sub-capillary structures 262 and the capillary layer 15 to achieve capillary communication, or to directly connect the plurality of second sub-capillary structures 262 to the capillary layer 15 to generate the capillary communication.

Figure 9:
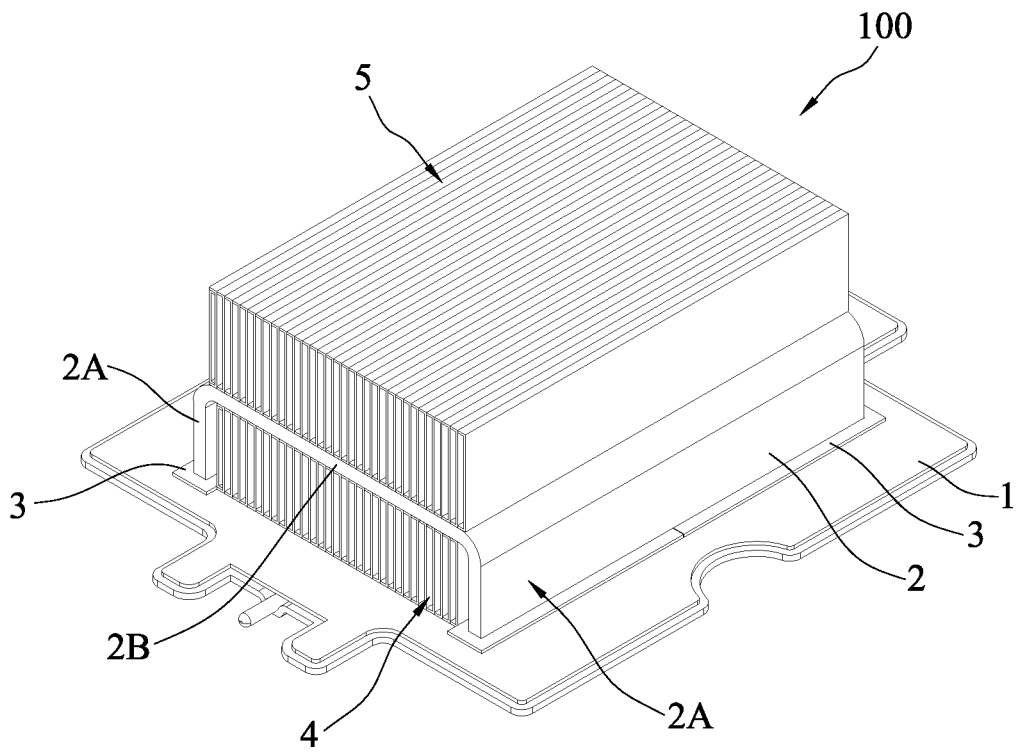
FIG. 9 is a schematic view of the heat dissipation device according to another embodiment of the present disclosure.

Referring to FIG. 9, the heat dissipation device 100 of the present disclosure may further include a first fin set 4 and a second fin set 5. The first fin set 4 is disposed between the first upper cover 11 and the second lower cover 22 and located between the two bending portions 2A. The second fin set 5 is disposed on the second upper cover 21 and completely corresponds to the middle portion 2B. In one embodiment, the fin arrangement direction of the first fin set 4 and the fin arrangement direction of the second fin set 5 are the same.

When the heat dissipation device 100 of the present disclosure is in operation, since the first chamber 14 is filled with the working fluid, the working fluid vaporizes after absorbing the heat energy of the heat source in contact with the first lower cover 12, and the vaporized working fluid enters the second chamber 23 via the second openings 24 without the first capillary structures 25. Since the middle portion 2B has a plate-like structure, the vaporized working fluid can effectively dissipate heat and condense via the first fin set 4 and the second fin set 5, and the condensed working fluid can flow back to the first chamber 14 via the first capillary structures 25 for the next heat dissipation cycle.

To sum up, in the heat dissipation device of the present disclosure, providing an annular second vapor chamber on the first vapor chamber can increase the contact area of more vaporized working fluid, so that the heat dissipation device of the present disclosure can efficiently absorb heat energy and dissipate heat when faced with a large amount of heat energy generated by a high-power processor. Therefore, the heat dissipation device of the present disclosure can provide higher heat dissipation efficiency as a whole, and can maintain effective and consistent heat dissipation.

The foregoing embodiments are provided for the purpose of illustrating the principles and effects of the present disclosure, rather than limiting the present disclosure. Anyone skilled in the art can modify and alter the above embodiments without departing from the spirit and scope of the present disclosure. Therefore, the scope of protection with regard to the present disclosure should be as defined in the accompanying claims listed below.

What is claimed is:

1. A heat dissipation device, comprising:

a first vapor chamber including a first upper cover, a first lower cover, two first openings and a capillary layer, wherein the first upper cover and the first lower cover are assembled with each other to surround and define a first chamber, the capillary layer is disposed on the first lower cover and located in the first chamber, the two first openings are spaced apart from each other and formed penetrating through the first upper cover and communicate with the first chamber, and the first lower cover is used to contact a heat source; and a second vapor chamber disposed on the first vapor chamber and including:

a second upper cover;

a second lower cover assembled with the second upper cover to form a plate-like structure, wherein the plate-like structure is bent by stamping to define two bending portions and a middle portion after the second upper cover and the second lower cover are assembled with each other, wherein the middle portion is spaced apart from the first upper cover, wherein the two bending portions are bent to connect opposite ends of the middle portion, and are respectively inserted into the two first openings to be connected to the first upper cover;

a second chamber communicated with the first chamber and surrounded and defined by the second lower cover and the second upper cover;

a plurality of first support units disposed on the second upper cover, located in the second chamber and corresponding to the middle portion;

a plurality of second support units disposed on the second upper cover, located in the second chamber, and respectively located on opposite sides of the plurality of first support units, wherein the plurality of second support units are long strips corresponding to the two bending portions and a part of the middle portion;

a plurality of second openings respectively formed in the two bending portions and communicating with the second chamber, wherein the plurality of second openings are located in the first chamber when the two bending portions are respectively inserted into the two first openings; and a plurality of first capillary structures accommodated in the second chamber and extended to the first chamber via the plurality of second openings and the two first openings respectively, wherein the plurality of first capillary structures are bonded to the capillary layer, wherein the first vapor chamber further comprises a bonding layer formed between the plurality of first capillary structures and the capillary layer, or formed on the capillary layer and covering the plurality of first capillary structures, wherein the bonding layer is composed of powdered metal and polymer material, and a weight ratio of the powdered metal to the polymer material is less than or equal to 1.

2. The heat dissipation device of claim 1, wherein the second vapor chamber further comprises a second capillary structure disposed on the second lower cover and located in the second chamber.

3. The heat dissipation device of claim 2, wherein the second vapor chamber further comprises a plurality of bumps extending outwardly from the second upper cover and the second lower cover respectively, so that one of the plurality of second openings is formed between any two of the plurality of bumps.

4. The heat dissipation device of claim 3, wherein the second capillary structure includes a second main capillary structure and a plurality of second sub-capillary structures, wherein the plurality of second sub-capillary structures overlap some of the plurality of bumps, and the plurality of second sub-capillary structures are connected to the second main capillary structure and in a capillary communication to the capillary layer.

5. The heat dissipation device of claim 2, wherein the second capillary structure is a powder sintered body or a mesh body, and the plurality of first capillary structures are strip-shaped fiber bodies.

6. The heat dissipation device of claim 1, wherein the plurality of first support units are cylinders.

7. The heat dissipation device of claim 1, wherein the first vapor chamber further comprises a plurality of pillars that are disposed on the first upper cover and located in the first chamber.

8. The heat dissipation device of claim 1, further comprising two annular members disposed on the first upper cover and surrounding the two first openings and the two bending portions respectively.

9. The heat dissipation device of claim 1, wherein an R angle formed by the two bending portions is one to two times a thickness of a plate formed by the second upper cover and the second lower cover.

10. The heat dissipation device of claim 1, wherein the second vapor chamber has a U-shaped cross-section.

11. The heat dissipation device of claim 1, further comprising a first fin set disposed between the first upper cover and the second lower cover and located between the two bending portions.

12. The heat dissipation device of claim 1, further comprising a second fin set disposed on the second upper cover and completely corresponding to the middle portion.

* * * * *